US006441282B2

(12) United States Patent
Tamura

(10) Patent No.: US 6,441,282 B2
(45) Date of Patent: Aug. 27, 2002

(54) STRINGED INSTRUMENT HAVING HEIGHT-ADJUSTABLE BRIDGE ASSEMBLY

(75) Inventor: Shinya Tamura, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/775,211

(22) Filed: Feb. 1, 2001

(30) Foreign Application Priority Data

Feb. 4, 2000 (JP) ..... 2000-027564

(51) Int. Cl.[7] ..... G10D 3/04
(52) U.S. Cl. ..... 84/307; 84/274; 84/298
(58) Field of Search ..... 84/307, 298, 299, 84/274, 290

(56) References Cited

U.S. PATENT DOCUMENTS

| | | | | |
|---|---|---|---|---|
| 2,455,452 A | | 12/1948 | Van Eps | |
| 2,972,923 A | * | 2/1961 | Fender | 84/313 |
| 3,290,980 A | * | 12/1966 | Fender | 84/307 |
| 4,635,523 A | | 1/1987 | Merchant | |
| 5,408,912 A | * | 4/1995 | Baity et al. | 84/307 |

FOREIGN PATENT DOCUMENTS

| | | | |
|---|---|---|---|
| JP | 403119388 | * | 5/1991 |
| TW | 098955 | | 5/1988 |
| TW | 212236 | | 9/1993 |
| TW | 274135 | | 4/1996 |
| TW | 277123 | | 6/1996 |

OTHER PUBLICATIONS

German Office Action dated Jan. 23, 2002.

* cited by examiner

*Primary Examiner*—Shih-Yung Hsieh
(74) *Attorney, Agent, or Firm*—Dickstein Shapiro, Morin & Oshinsky LLP

(57) ABSTRACT

A stringed instrument such as a contrabass uses a height-adjustable bridge assembly for supporting strings under tension with a desired height, which is manually adjusted by a human operator. The bridge assembly is mainly constructed by a bridge whose lower end portion is forked to form a pair of legs and a pair of height-adjustment members, each of which is constructed by a screw rod and a foot. The legs of the bridge are respectively assembled together with the height-adjustment members being held inside of a hollow which is formed at a prescribed position and elongated in a direction roughly perpendicular to the strings being stretched on a belly of the stringed instrument. Herein, each leg has a hole formed with an internal thread which engages with an upper portion of the screw rod whose lower portion is buried in the foot which is held inside of the hollow in a free rotation manner. Hence, it is possible for the human operator to manually adjust a height of the bridge by merely rotating the feet within the hollow on the stringed instrument while temporarily loosening the strings. Because of elimination of adjustment screws, it is possible to construct the bridge assembly with a reduced number of parts as compared with conventional ones. In addition, metal parts (i.e., screw rods) are completely hidden inside of wood parts of the bridge assembly to provide least resistance in visuality.

9 Claims, 4 Drawing Sheets

STRINGED INSTRUMENT HAVING HEIGHT-ADJUSTABLE BRIDGE ASSEMBLY

BACKGROUND OF THE INVENTION

1. Field of the Invention

This invention generally relates to stringed instruments, and particularly to large-size stringed instruments such as contrabasses in which intermediate portions of strings are supported by bridges having height-adjustment functions.

2. Description of the Related Art

Generally, stringed instruments have bridges for supporting strings under tension. Particularly, large-size stringed instruments such as contrabasses use bridges that stand on bellies of the instruments to support intermediate portions of strings under tension. Those bridges are made by pieces of wood, namely, wood plates which are normally made of hard wood materials such as maple and which are gradually reduced in thickness toward tip ends. Each of those bridges has four grooves at an upper portion thereof, so that four strings are respectively engaged with the four grooves of the bridge. In addition, a lower end portion of the bridge is forked to form two leg portions. Normally, there are provided two types of the bridges, namely, a first type of the bridge that is attached to the belly of the stringed instrument in a height-adjustable manner and a second type of the bridge that does not have a height-adjustment function. FIG. 4 shows an example of the conventional bridge that is merely attached to the belly of the stringed instrument without having a height-adjustment function. In FIG. 4, a reference numeral 1 designates a bridge, 2 designates a body (or belly) of a stringed instrument, 3 designates four grooves for supporting four strings 4 respectively, and 5 designates two legs of the bridge 1. FIG. 5 shows an example of the conventional bridge that is attached to the belly of the stringed instrument in a height-adjustable manner. In addition to the aforementioned elements shown in FIG. 4, the bridge shown in FIG. 5 provides a pair of heightadjustment members 6 for supporting the two legs 5 respectively. Each of the height-adjustment members 6 contains an internally-threaded member (or nut) 7, a screw rod 8, a foot 9 and an adjustment screw 10. Herein, the screw rod 8 engages with the internally-threaded member 7 which is buried in the foot 9 being attached on the stringed instrument 2, and the adjustment screw 10 engages with an intermediate portion of the screw rod 8 whose upper portion is inserted into a hole 11 which is formed inside of the leg 5 to communicate with its lower surface. The adjustment screw 10 has a disk-like shape whose upper surface supports the lower surface of the leg 5. When being rotated, the adjustment screw 10 moves up or down along the screw rod 8, so that a height of the bridge 1 is being adjusted. Lifting up the bridge 1, the upper portion of the screw rod 8 can be easily extracted from the hole 11 of the leg 5. Hence, it is possible to easily remove the bridge 1 from the height-adjustment members 6 that are fixedly attached to the belly of the stringed instrument 2. In other words, if a human operator (or player) holds the stringed instrument 2 such that the bridge 1 is placed in a downward direction, the bridge 1 is being easily dropped from the height-adjustment members 6 attached to the belly of the stringed instrument 2.

As described above, the bridge shown in FIG. 4 bears a drawback due to lack of the height-adjustment function. It may be possible to compulsorily provide the bridge of FIG. 4 with a height-adjustment function, which is realized by shaving the legs 5 to be shorter. However, once the legs 5 are shaved to be shorter so that a height of the bridge is being reduced, it becomes impossible to increase the height of the bridge. In contrast to the bridge of FIG. 4, the bridge of FIG. 5 has height-adjustment members 6 by which the bridge can be freely adjusted in height. However, the bridge of FIG. 5 bears a problem due to plenty of parts because each leg portion is constructed by five members, namely, the leg 5, internally-threaded member 7, screw rod 8, foot 9 and adjustment screw 10. In addition, the screw rod 8 and adjustment screw 10 are made of metal materials, which may cause a problem in visuality as compared with the "wood" bridge. That is, a player may feel visual wrongness or reluctance in watching those "metal" parts that appear in connection with the "wood" bridge. Further, the bridge of FIG. 5 is constructed such that the upper portion of the screw rod 8 is merely inserted into the hole 11 of the leg 5. So, if the screw rods 8 are removed from the stringed instrument 2, it becomes easy to disassemble the bridge 1 from the height-adjustment members 6. That is, it is difficult for the human operator (or player) to handle the bridge 1 being attached to the stringed instrument 2.

SUMMARY OF THE INVENTION

It is an object of the invention to provide a height-adjustable bridge assembly for use in a stringed instrument by a reduced number of parts including metal parts which are arranged inconspicuously inside of wood materials to provide least resistance in visuality.

A stringed instrument such as a contrabass uses a height-adjustable bridge assembly for supporting strings under tension with a desired height, which is manually adjusted by a human operator. The bridge assembly of this invention is mainly constructed by a bridge whose lower end portion is forked to form a pair of legs and a pair of height-adjustment members, each of which is constructed by a screw rod and a foot. The legs of the bridge are respectively assembled together with the height-adjustment members being held inside of a hollow which is formed at a prescribed position and elongated in a direction roughly perpendicular to the strings being stretched on a belly of the stringed instrument. Herein, each leg has a hole formed with an internal thread which engages with an upper portion of the screw rod whose lower portion is buried in the foot which is held inside of the hollow in a free rotation manner. Hence, it is possible for the human operator to manually adjust a height of the bridge by merely rotating the feet within the hollow on the stringed instrument while temporarily loosening the strings. This guarantees easy manual operations for the human operator in adjustment of the height of the bridge and adjustment of stretching the strings on the stringed instrument.

Because of elimination of adjustment screws, it is possible to construct the bridge assembly with a reduced number of parts as compared with conventional ones. In addition, metal parts (i.e., screw rods) are completely hidden inside of wood parts of the bridge assembly to provide least resistance in visuality.

BRIEF DESCRIPTION OF THE DRAWINGS

These and other objects, aspects and embodiment of the present invention will be described in more detail with reference to the following drawing figures, of which.

Figure 3:
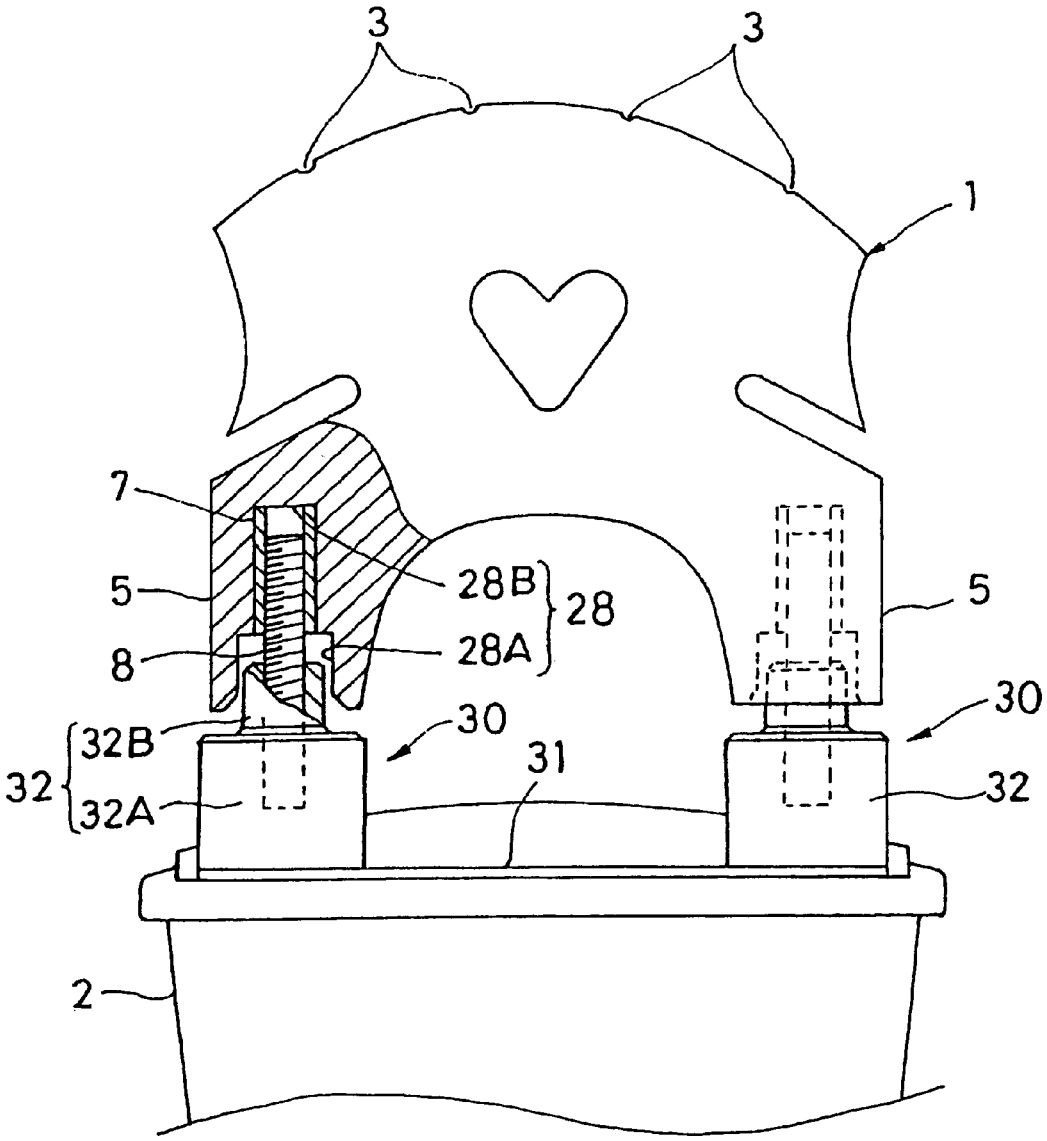
Figure 4:
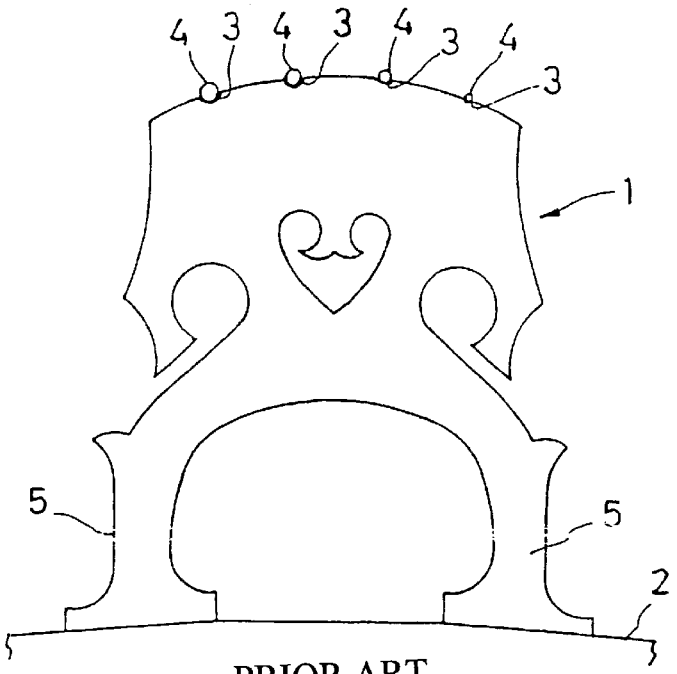
PRIOR ART FIG. 4
Figure 5:
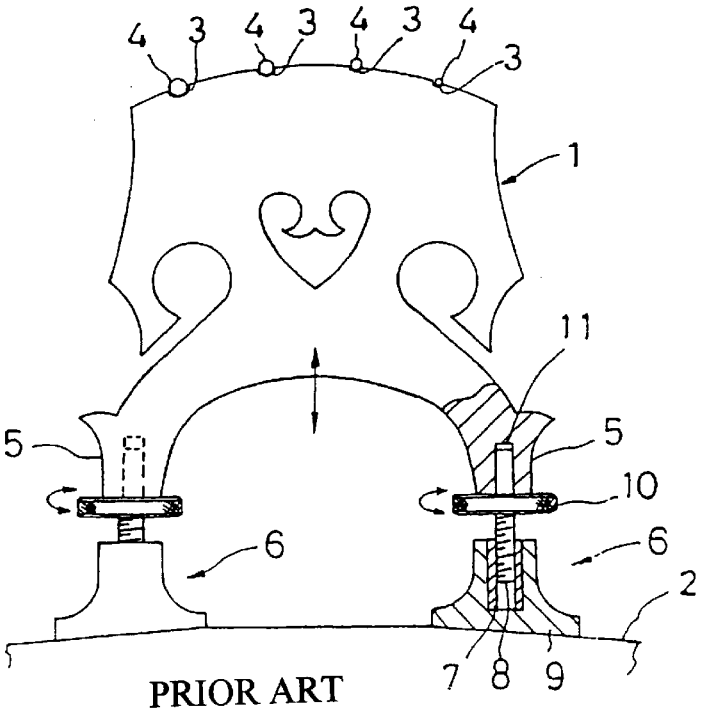
PRIOR ART FIG. 5

F1G. 2 is a side view showing the electric contrabass in which strings are supported by a bridge and a nut at difference positions;

FIG. 3 is an enlarged front view partly in section showing a construction of the height-adjustable bridge used for the electric contrabass;

FIG. 4 is an enlarged front view showing a bridge that does not have a height-adjustment function on a stringed instrument; and FIG. 5 is an enlarged front view partly in section showing a bridge that has a height-adjustment function on a stringed instrument.

DESCRIPTION OF THE PREFERRED EMBODIMENT

This invention will be described in further detail by way of examples with reference to the accompanying drawings.

Figure 1:
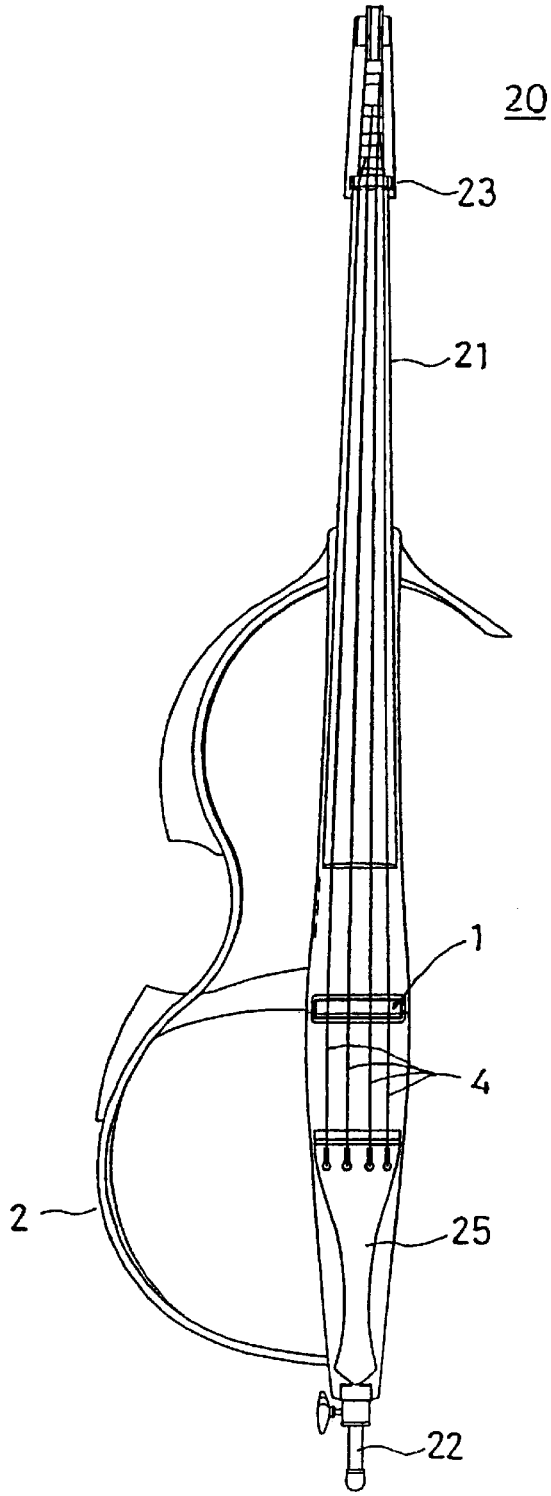
FIG. 1 is a front view showing an appearance of an electric contrabass having a height-adjustable bridge in accordance with a preferred embodiment of the invention.
Figure 2:
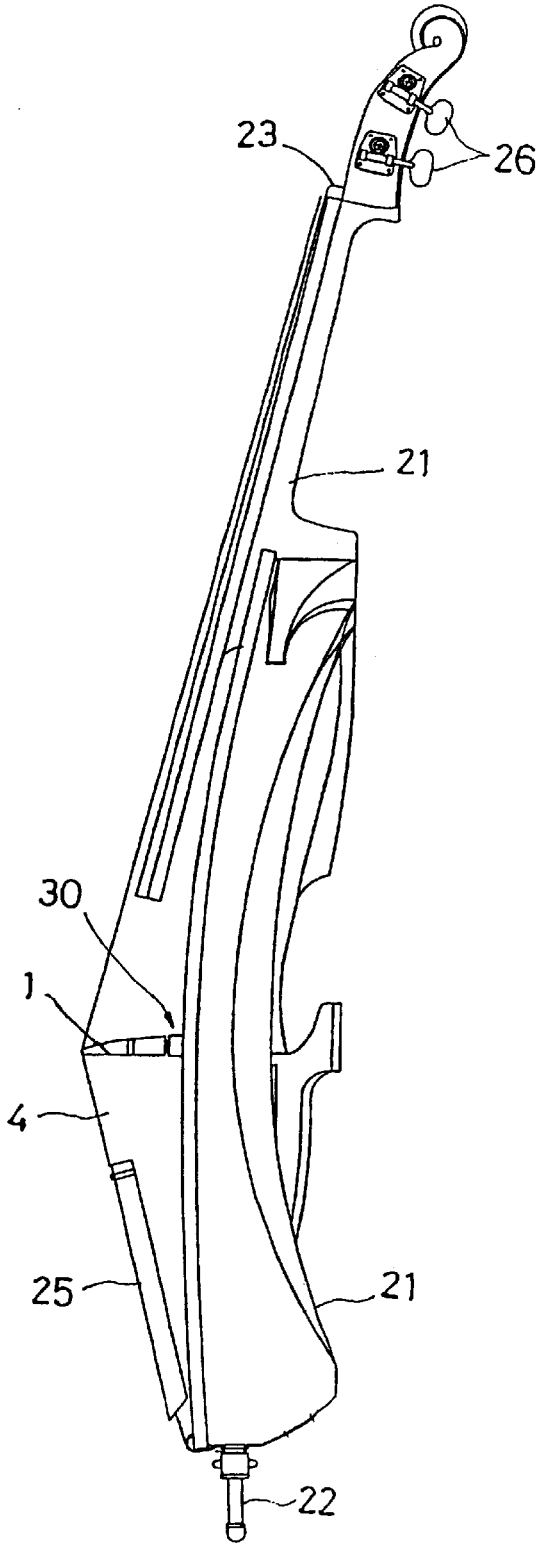

FIG. 1 shows a partial appearance in front view of an electric contrabass that has a bridge for supporting intermediate portions of strings in accordance with a preferred embodiment of the invention. FIG. 2 shows an appearance in side view of the contrabass, and FIG. 3 shows construction of the bridge partly in section for use in the contrabass. In FIGS. 1, 2 and 3, parts identical to those shown in FIGS. 4 and 5 are designated by the same reference numerals, hence, the detailed description will be omitted. As shown in FIG. 1, an electric contrabass (simply referred to as a contrabass) 20 is mainly constructed by a body 2, a neck 21, four strings 4, an end pin 22, a nut 23, a bridge 1 and a tailpiece 25. That is, the neck 21 is an elongated rod-like part that supports a finger board on a front side of the contrabass 20, and the end pin 22 can be freely stretched and contracted on a lower end portion of the tailpiece 25. The nut 23 is attached to an upper end portion of the neck 21 in proximity to its head portion (or peg portion), while the bridge 1 is attached to an intermediate portion or a lower portion of the body 2 to support the strings 4 whose ends are terminated on an upper section of the tailpiece 25.

The body 2 of the electric contrabass 20 incorporates a pickup device (not shown) for detecting vibrations of the strings 4, which are corrected in tone color by an electronic circuit (e.g., equalizer). Thus, it is possible to reproduce contrabass sounds on the electronic contrabass 20. Connecting headphones, it is possible for a player to enjoy playing the electric contrabass 20 in mute performance. Connecting an amplifier, it is possible for audience to listen to musical performance on the electric contrabass 20 by speakers. In addition, it is possible to connect the electric contrabass 20 with other electric instruments, mute performance instruments and CD players. Thus, the player of the electric contrabass 20 is capable of playing music in an ensemble with other players. Because the electric contrabasses are normally designed to electronically produce sounds by processing tone colors thereof, it is unnecessary to provide the electric contrabasses with resonance functions that are originally provided for acoustic contrabasses.

There are provided four strings 4, namely, first to fourth strings, end portions of which are wound about pegs 26, provided in the head portion of the neck 21, and terminated. Hence, upper portions of the strings 4 are supported by the nut 23 in proximity to the pegs 26. Another end portions of the strings are terminated on the tailpiece 25, which is arranged in a lower end portion of the body 2. Hence, lower portions of the strings 4 are supported by the bridge 1 which is arranged relatively close to the tailpiece 25.

As similar to the conventional bridges, the bridge 1 shown in FIG. 1 is made of hard wood material and is formed in a plate-like shape. In addition, four grooves 3 are formed on an upper end portion of the bridge 1 to engage with four strings 4 respectively. Further, a lower end portion of the bridge 1 is forked to form a pair of legs 5. A pair of the legs 5 of the bridge 1 are respectively supported by a pair of height-adjustment members 30, which are attached to a belly of the stringed instrument 2 in a height-adjustable manner. Specifically, the height-adjustment members 30 are partially inserted into and engaged with a hollow 31, which is formed at a prescribed position on a surface of the belly of the stringed instrument 2 and which is elongated in a prescribed length and in a direction roughly perpendicular to directions of stretching the strings 4. A hetero-bore hole 28 consisting of a large-bore hole 28A and a small-bore hole 28B is formed in each leg 5 to communicate with its lower surface. Herein, the small-bore hole 28B is formed inside of the leg 5 to follow the large-bore hole 28A that communicates with the lower surface of the leg 5, wherein an internally-threaded member (or nut) 7 is buried in the small-bore hole 28B. The present embodiment describes such that an internal thread of the small-bore hole 28B is formed by the internally-threaded member 7 which is made of metal material. The material used for formation of the internal thread of the small-bore hole 28B is not necessarily limited to the metal material, hence, it is possible to employ other materials for formation of the internal thread. Or, it is possible to directly form the internal thread in the small-bore hole 28B by tapping or else.

The body of the stringed instrument 2 as a whole is roughly formed to have a concave surface, on which the hollow 31 is being formed at the predetermined position. Herein, a bottom surface of the hollow 31 is formed as a flat surface, which allows rotation of the height-adjustment members 30 with ease.

Each of the height-adjustment members 30 is mainly constructed by two members, namely, a foot 32 and a screw rod 8. The foot 32 as a whole is formed as a hetero-diameter cylinder which is made of wood material and which consists of a large-diameter portion 32A and a small-diameter portion 32B. The large-diameter portion 32A is partially inserted into and engaged with the hollow 31, while the small-diameter portion 32B projects upwardly from an upper surface of the large-diameter portion 32A. In addition, a lower portion of the screw rod 8 is buried in the foot 32, and an upper portion of the screw rod 8 projects upwardly from an upper surface of the small-diameter portion 32B. A lower surface of the large-diameter portion 32A is made flat to match with the bottom surface of the hollow 31, wherein the large-diameter portion 32A is inserted into the hollow 31 in a free rotation manner. When the height-adjustment member 30 is assembled together with the leg 5 of the bridge 1, the small-diameter portion 32B of the foot 32 engages with the large-bore hole 28A of the leg 5 so that an external thread of the screw rod 8 engages with the internal thread of the internally-threaded member 7 in the small-bore hole 28A. Due to such construction, the player or other persons are unable to visually recognize existence of the screw rod 8, which is completely hidden inside of the leg 5 and the heightadjustment member 30. Thus, the player or other persons do not feel wrongness or reluctance in appearance of the metal part corresponding to the screw rod 8 in the bridge 1. Incidentally, the present embodiment uses the "metal" screw rod 8 as a connection member to provide sufficient durability and sustainability. Of course, material used for formation of the connection member between the leg 5 and foot 32 is not necessarily limited to the metal material. Hence, it is possible to employ other materials that are capable of sufficiently bearing tension of the strings 4 which are stretched on the stringed instrument 2. For example, it is possible to modify the present embodiment such that the connection member made of wood material is formed integrally together with the foot 32.

In order to adjust a height of the bridge 1 on the belly of the stringed instrument 2, a human operator rotates the foot 32 by his/her hand so that the internally-threaded member 7 of the leg 5 moves up or down along the screw rod 8. Thus, it is possible to adjust the bridge 1 in a desired height. Incidentally, it may be difficult for the human operator to adjust the height of the bridge 1 under a condition where the strings 4 are stretched under tension. Hence, it may be required for the human operator to adjust the height of the bridge 1 by loosening the strings 4 on the stringed instrument 2. The present embodiment is constructed such that the legs 5 of the bridge 1 are firmly connected together with the height-adjustment members 30 by engagement of the internally-threaded members 7 and screw rods 8. So, even if the strings 4 are temporarily removed from the stringed instrument 2, the bridge 1 is not easily disassembled from the height-adjustment members 30. This guarantees easy manual operations for the human operator in adjustment of the height of the bridge 1 and adjustment of stretching the strings 4. In addition, the bridge of the present embodiment shown in FIG. 3 does not need the adjustment screws 10 which are conventionally used for adjustment of the height of the bridge shown in FIG. 5 because the "rotatable" feet 32 substitute for the adjustment screws 10. Thus, it is possible to reduce a number of parts used for the bridge and its height-adjustment members. In addition, the feet 32 are made of the wood material as similar to the bridge 1, and the "metal" screw rods 8 are inserted into the hetero-bore holes 28 of the legs 5 together with prescribed parts of the feet 32, so that the metal parts are completely hidden inside of the legs 5 and feet 32. Thus, the player or other persons do not visually recognize existence of the metal parts but apparently recognize such that the bridge and its associated parts are all made of wood materials. Due to such construction, the player or other persons do not feel wrongness or reluctance in visuality with respect to the stringed instrument having the aforementioned height-adjustable bridge.

Lastly, the present embodiment merely describes an example of application of this invention to the electric contrabass and its bridge. Of course, this invention is not necessarily limited to the aforementioned embodiment. Hence, it is possible to apply this invention to "acoustic" stringed instruments such as acoustic contrabasses.

As described heretofore, this invention has various effects and technical features, which are described below.

(1) A stringed instrument such as a contrabass uses a height-adjustable bridge assembly, which is constructed such that legs of the bridge are respectively connected with height-adjustment members, each of which is mainly constructed by a foot and a screw rod. Herein, the screw rod is inserted into a hole of the leg to engage with its internal thread. Adjustment of a height of the bridge is realized by manually rotating the feet which are respectively connected with the legs of the bridge and which are partially inserted into a hollow formed at a prescribed position on a belly of the stringed instrument. Because of elimination of adjustment screws whose functions are realized by the "rotatable" feet and screw rods, the bridge assembly of this invention uses a reduced number of parts as compared with conventional ones. In addition, the height-adjustment members are not easily dropped and separated from the bridge unless a human operator releases engagement of the screw rods and internal threads. This guarantees easy manual operations for the human operator (or player) in adjustment of the height of the bridge and adjustment of stretching strings on the stringed instrument.

(2) In the stringed instrument, the bridge assembly is subjected to positioning so that the height-adjustment members are tightly held at prescribed positions in a free rotation manner inside of a hollow, which is formed at a prescribed position and is elongated in a direction perpendicular to strings being stretched. So, even if the strings are loosened, there is a small probability in that the bridge assembly is changed in positioning within the hollow. Because the height-adjustment members are made rotatable within the hollow, it is possible to realize adjustment of the height of the bridge by merely loosening the strings on the stringed instrument.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A bridge assembly for use in a stringed instrument, comprising:

a bridge for supporting strings under tension, a lower end portion of which is forked to form a pair of legs respectively having holes formed with internal threads; and a pair of height-adjustment members for respectively supporting the legs of the bridge, wherein each of the height-adjustment members is constructed by a screw rod and a foot, wherein an upper portion of the screw rod whose lower portion is buried in the foot is placed to engage with the internal thread of the hole of the leg being connected with the height-adjustment member, and wherein the foot is manually rotatable by the hand of a human operator.

2. A bridge assembly according to claim 1 wherein each of the height-adjustment members is roughly formed in a cylindrical shape.

3. A bridge assembly according to claim 1 wherein the height-adjustment member consists of a large-diameter portion and a small-diameter portion, while the hole of the leg consists of a large-bore hole and a small-bore hole, so that the small-diameter portion formed on the large-diameter portion matches with the large-bore hole which communicates with the small-bore hole having the internal thread within the leg.

4. A stringed instrument comprising:

a body;

a plurality of strings being stretched along a neck;

a hollow which is formed at a prescribed position and is elongated in a direction roughly perpendicular to the strings being stretched under tension;

a bridge for supporting the plurality of strings under tension, a lower end portion of which is forked to form a pair of legs respectively having holes formed with internal threads; and a pair of height-adjustment members for respectively supporting the legs of the bridge, wherein each of the height-adjustment members is constructed by a screw rod and a foot which is partially held inside of the hollow in a free rotation manner and is manually rotatable by the hand of a human operator within the hollow, wherein an upper portion of the screw rod whose lower portion is buried in the foot is placed to engage with the internal thread of the hole of the leg being connected with the height-adjustment member.

5. A stringed instrument according to claim 4 wherein each of the height-adjustment members is roughly formed in a cylindrical shape.

6. A stringed instrument according to claim 4 wherein the height-adjustment member consists of a large-diameter portion and a small-diameter portion, while the hole of the leg consists of a large-bore hole and a small-bore hole, so that the small-diameter portion formed on the large-diameter portion being held inside of the hollow matches with the large-bore hole which communicates with the small-bore hole having the internal thread within the leg.

7. A stringed instrument comprising:

a body having a neck arranged to receive a plurality of strings being stretched along said neck;

a hollow which is formed at a prescribed position and is elongated in a direction roughly perpendicular to neck along which the strings will be received and stretched under tension;

a bridge for supporting the plurality of strings under tension, a lower end portion of which is forked to form a pair of legs respectively having holes formed with internal threads; and a pair of height-adjustment members for respectively supporting the legs of the bridge, wherein each of the height-adjustment members is constructed by a screw rod and a foot which is partially held inside of the hollow in a free rotation manner and is manually by the hand of a human operator within the hollow, wherein an upper portion of the screw rod whose lower portion is buried in the foot is placed to engage with the internal thread of the hole of the leg being connected with the height-adjustment member.

8. A stringed instrument according to claim 7 wherein each of the height-adjustment members is roughly formed in a cylindrical shape.

9. A stringed instrument according to claim 7 wherein the height-adjustment member consists of a large-diameter portion and a small-diameter portion, while the hole of the leg consists of a large-bore hole and small-bore hole, so that the small-diameter portion formed on the large-diameter portion being held inside of the hollow matches with the large-bore hole which communicates with the small-bore hole having the internal thread within the leg.

* * * * *